United States Patent [19]

Moriguchi et al.

[11] Patent Number: 4,502,065

[45] Date of Patent: Feb. 26, 1985

[54] TRANSFER TYPE HEAT-SENSITIVE RECORDING MEDIUM

[75] Inventors: Haruhiko Moriguchi; Yoshiki Kikuchi; Takashi Ohmori, all of Kanagawa, Japan

[73] Assignee: Fuji Xerox Co., Ltd., Tokyo, Japan

[21] Appl. No.: 465,373

[22] Filed: Feb. 10, 1983

[30] Foreign Application Priority Data

Feb. 10, 1982 [JP] Japan ..... 57/18788

[51] Int. Cl.[3] ..... B41M 5/18

[52] U.S. Cl. ..... 346/204; 346/214; 346/226; 427/150; 427/151; 427/152; 427/256; 428/488.4; 428/913; 428/914; 430/254

[58] Field of Search ..... 282/27.5; 427/150–153, 427/256; 428/320.4–320.8, 411, 488, 537, 913, 914, 411.1, 488.1, 488.4, 537.5; 430/254; 346/204, 214, 216, 226

[56] References Cited

FOREIGN PATENT DOCUMENTS 79442 6/1980 Japan ..... 346/226

118032 9/1980 Japan ..... 430/254

*Primary Examiner*—Bruce H. Hess

*Attorney, Agent, or Firm*—Sughrue, Mion, Zinn, Macpeak & Seas

[57] ABSTRACT

A transfer type heat-sensitive recording medium having a porous base impregnated with a colorless color former. A layer of thermally melting ink is formed on one side of the porous base. The first layer is brought into contact with a recording sheet. A layer of thermally melting wax containing a color developer is formed on the opposite side of said porous base and selectively heated according to a video signal. The wax melts and permeates into the porous base to allow the color developer to color on reaction with the colorless color former. The wax layer is further heated by thermal irradiating so that the ink of the ink layer is molten in correspondence to the coloring.

10 Claims, 2 Drawing Figures

TRANSFER TYPE HEAT-SENSITIVE RECORDING MEDIUM

BACKGROUND OF THE INVENTION

This invention relates to a transfer type heat-sensitive recording medium of a type wherein a thermally melting ink is transferred onto a recording sheet by being heated to record given data. More particularly, it relates to a transfer type heat-sensitive recording medium which serves to quickly record images of high resolution.

A conventional transfer type heat-sensitive recording medium is prepared by applying thermally melting ink onto the surface of a thin base of capacitor paper. In recording data by using such a transfer type heat-sensitive recording medium, the following method is generally employed. A thermal head is brought into contact with the thermally melting ink, so that the ink is transferred onto the recording sheet.

With the transfer type heat-sensitive recording medium, the thermally melting ink is heated through the base thereof. Therefore, heat is diffused in the recording medium itself. In this operation heat is also diffused in the thermal head. Therefore, the recording medium is disadvantageous in that the resolution is not more than about 8 to 12 lines/mm.

In order to increase the recording speed, it is necessary to increase energy applied to the thermal head, and in this case, the heating temperature of the heat-sensitive recording medium is also increased. As a result, the degree of heat diffusion in the recording medium and the thermal head are increased. Accordingly, the resolution is lowered, which prevents a high speed recording operation.

SUMMARY OF INVENTION

Accordingly, an object of this invention is to provide a transfer type heat-sensitive recording medium in which the above-described drawbacks accompanying a conventional transfer type heat-sensitive recording medium have been eliminated.

It is another object of this invention to define a transfer type heat-sensitive recording medium wherein images high in resolution can be recorded quickly.

The foregoing and other objects of the invention are achieved by the provision of a transfer type heat-sensitive recording medium which comprises a porous base impregnated with a colorless color former, a layer of thermally melting wax containing a color developer agent for the colorless color former, which is formed on one side of the porous base, and a layer of thermally melting ink which is formed on the opposite side of the porous base.

In accordance with the invention, the layer of thermally melting ink is brought into contact with a recording sheet. The wax layer is selected heated by a video signal and melts to permeate into the porous base. This allows the colorless color to color on reaction with the colorless color former. The wax is further heated by thermal irradiation so that the ink melts in correspondence to the coloring.

This invention will be described in greater detail by reference to the accompanying drawing and the description of the preferred embodiment that follows.

DESCRIPTION OF THE PREFERRED EMBODIMENT

Figure 1:
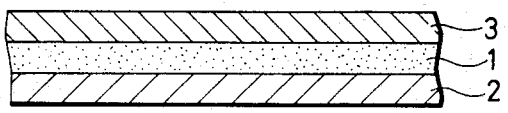
FIG. 1 is a sectional view showing one example of a transfer type heat-sensitive recording medium according to this invention.

One preferred embodiment of this invention will now be described with reference to the accompanying drawing. In the accompanying drawing, FIG. 1 is a sectional view showing one example of a transfer type heat-sensitive recording medium according to the invention, and FIG. 2 is an explanatory diagram, partly as a sectional view, showing the heat-sensitive recording medium in FIG. 1 which is applied to a heat-sensitive transfer type recording device.

In these Figures, reference numeral 1 designates a porous base impregnated with hypochromic colorless color former. A layer of thermally melting wax containing a color developer for the aforementioned colorless color former is identified as element 2. A layer 2 as shown in FIG. 1 is formed on one surface of the porous base 1. A layer of thermally melting ink 3 is formed on the opposite surface of the porous base 1 from the wax layer 2.

Figure 2:
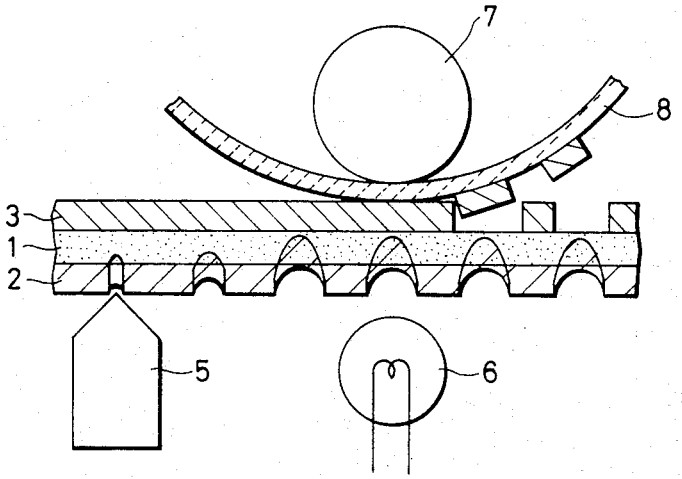
FIG. 2 is an explanatory diagram, partly as a sectional diagram, showing the recording medium in FIG. 1 which is applied to a heat-sensitive transfer type recording device.

In FIG. 2, reference numeral 5 designates a thermal head which abuts against the thermally melting wax layer 2 to heat it. An infrared lamp 6 is disposed downstream of the thermal head 5. The infrared lamp 6 operates to apply infrared rays to the thermally melting wax which has been previously heated by the thermal head 5, in order to further heat the wax.

In FIG. 2, reference numeral 7 designates a pressing roll disposed on the side of the heat-sensitive recording medium opposite the heating elements 5 and 6. The roll 7 operates to press a recording sheet 8 against the thermally melting ink layer 3.

In a recording operation using the above-described transfer type heat-sensitive recording medium, first the thermal head 5 is abutted against the thermally melting wax layer 2, and then the wax 2 is heated in response to a video signal input to the thermal head 5 in a suitable manner.

When the thermally melting wax layer 2 is heated by the thermal head, the wax in those portions of the layer 2 which has been heated permeate the porous base 1. Thereupon, the color former such as a fluorene colorless color former impregnates into the base 1 as in the ordinary heat-sensitive recording medium, reacts with the color developer such as bisphenol contained in the wax, to form a black pattern.

In this condition, the surface of the thermally melting wax layer 2 passes the lamp 6. It is irradiated by infrared rays from the lamp 6. In this operation, only the black pattern absorbs the heat of infrared rays thus applied, to selectively melt the ink in the layer 3.

The recording sheet 8 is pressed against the thermally melting ink layer 3 by the roll 7 opposite the lamp 6. The molten ink in the layer 3 is thereby transferred onto the recording sheet 8. Thus, the recording operation is achieved.

The energy which is applied to the thermal head for formation of the above-described black pattern is smaller than that required in a recording operation using the ordinary ink donor sheet in which the ink layer is heated through the base. The heating time is also shorter. The reason for this improvement is that the thermally melting wax to be heated is brought into direct contact with the thermal head 5. Accordingly, the recording speed can be increased according to the invention.

As was described herein, the heat generating means is very close to the thermally melting ink layer 3, and accordingly, the degree of heat diffusion is less. Although heat is diffused in the thermal head, a record high in resolution can be obtained.

In experiments performed by the inventors, the porous base 1 was formed by impregnating fluorene leuco colorless color former into Japanese paper (Wickstroemia Sikokina Fr.et.Sab) 10 μm in thickness.

The color developer was prepared by uniformly dispersing bisphenol A in ester wax, the thermally melting wax. Furthermore, in order to improve the contrast of a black pattern formed through the reaction of the fluorene leuco pigment and bisphenol A, the thermally melting wax 2 is prepared by mixing calcium carbonate with the aforementioned ester wax to make the non-colored region white. It was applied to one surface of the porous base 1.

Thermally melting ink similar to that applied to the ordinary ink doner sheet, containing ester wax, carnauba wax, carbon black and castor oil, was applied to the opposite surface of the porous base 1, to form a transfer type thermally recording medium. With the recording medium thus formed, a recording operation was carried out in the above-described manner. As a result, an image of high resolution was recorded at high speed.

The transfer type heat-sensitive recording medium according to the invention therefore comprises the porous base impregnated with the colorless color former, the thermally melting wax applied to one surface of the porous base, the wax containing the color developer for the colorless color former, and the thermally melting ink layer applied to the other surface of the porous base, as described above. Such a recording medium is advantageous in that an image of high resolution can be recorded at high speed.

In addition, the invention offers another advantage in that recording data on the recording sheet and coloring an image on the recording medium are carried out simultaneously.

We claim:

1. A transfer type heat-sensitive recording medium comprising:

a porous base impregnated with a colorless color former;

a layer of thermally melting ink formed on one side of the porous base;

a layer of thermally melting wax containing a color developer formed on said porous base on the side opposite said ink layer, said wax being selectively heated according to a video signal to permeate into said porous base and allow said color developer to color on reaction with said colorless color former, said wax layer being further heated whereby said ink melts in correspondence with said coloring for transfer onto a recording sheet.

2. The recording medium of claim 1, wherein said porous base comprises fluorene leuco colorless color former impregnated into paper.

3. The recording medium of claim 1, wherein said thermally melting wax comprises ester wax and said color developer is bisphenol A dispersed in said ester wax.

4. The recording medium of claim 3, wherein said thermally melting wax further comprises a contrast forming media.

5. The recording medium of claim 4, wherein said contrast forming media comprises calcium carbonate wax mixed with said ester wax.

6. The recording medium of claim 1, wherein said thermally melting ink comprises wax, a color developer and an oil medium.

7. The recording medium of claim 6, wherein the wax in said thermally melting ink comprises ester wax and said color developer is carbon black.

8. A method of obtaining an image from an electronic signal comprising the steps of:

moving a transfer type of heat-sensitive recording medium having a porous base impregnated with a colorless color former, a layer of thermally melting ink on one side of said porous base and a layer of thermally melting wax containing a color developer formed on an opposite side of said porous base in proximity to a thermal head receiving an input electronic signal with said wax layer confronting said thermal head;

selectively heating and melting said wax layer in accordance with said input signal wherein said wax permeates said porous base to allow the color developer to color on reaction with said colorless color former;

further heating said wax layer to melt said ink in correspondence with said coloring; and transferring said molten ink onto a recording sheet in contact with said ink layer.

9. The method of claim 8 further comprising the step of applying pressure to said recording medium and said recording sheet when said further heating of said wax layer takes place.

10. The method of claim 8, wherein transferring molten ink onto said recording sheet and coloring an image in the recording medium takes place substantially simultaneously.

* * * * *